US009506710B2

(12) United States Patent
Smith

(10) Patent No.: US 9,506,710 B2
(45) Date of Patent: Nov. 29, 2016

(54) MODULAR SILENCER SYSTEM

(71) Applicant: RA Brands, L.L.C., Madison, NC (US)

(72) Inventor: Michael Leighton Smith, Alpharetta, GA (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 14/994,567

(22) Filed: Jan. 13, 2016

(65) Prior Publication Data

US 2016/0209150 A1 Jul. 21, 2016

Related U.S. Application Data

(60) Provisional application No. 62/104,209, filed on Jan. 16, 2015.

(51) Int. Cl.
*F41A 21/30* (2006.01)
*F41A 21/00* (2006.01)

(52) U.S. Cl.
CPC ..... *F41A 21/30* (2013.01)

(58) Field of Classification Search
CPC ..... F41A 21/30; F41A 21/325
USPC ..... 181/223; 89/14.4, 14.3, 14.2
See application file for complete search history.

(56) References Cited

U.S. PATENT DOCUMENTS 959,400 A * 5/1910 Stinson ..... F41A 21/30 181/223
1,021,742 A 3/1912 Moore
1,111,202 A 9/1914 Westfall
1,259,251 A 3/1918 Love
1,342,978 A 12/1919 Young
1,427,802 A 9/1922 Goodwin
1,667,186 A 4/1928 Bluehdorn
1,770,471 A 7/1930 Hatcher
2,315,207 A 3/1943 Frantisek et al.
2,503,491 A 4/1950 Janz
2,514,996 A 7/1950 Faust, Jr.
2,792,760 A 5/1957 Hammer
3,164,060 A 1/1965 Dahl (Continued)

FOREIGN PATENT DOCUMENTS

AU 198430045 A 1/1986
AU 2009201323 A1 10/2009

(Continued)

OTHER PUBLICATIONS

Element PBS-1 Silencer for AK Series (https://raid-airsoft.com/2014/02/24/element-pbs-1-silencer-for-ak-series/) R.A.I.D. Raid-Airsoft, printed date Jun. 10, 2016.

*Primary Examiner* — Edgardo San Martin
(74) *Attorney, Agent, or Firm* — Womble Carlyle Sandridge & Rice, LLP

(57) ABSTRACT

Embodiments of the present disclosure may include a silencer or noise suppressor having a rearward portion that may be coupled to the barrel of a firearm and a forward portion that can mate with the rearward portion such that a length of the rearward portion may at least partially overlap an exterior surface of the forward portion. The forward portion may include an interior chamber that can receive a baffle core having a core body made up of a series of spaced peripheral portions, and at least a portion of the baffle core may protrude from the interior chamber so as to be substantially sealed between the rearward and forward portions.

20 Claims, 4 Drawing Sheets

(56) References Cited

U.S. PATENT DOCUMENTS 3,667,570 A 6/1972 WerBell, III
3,786,895 A 1/1974 Perrine
4,384,507 A * 5/1983 Finn ..... F41A 21/30 181/241
4,510,843 A 4/1985 Rabatin
4,576,083 A 3/1986 Seberger, Jr.
4,588,043 A 5/1986 Finn
4,679,597 A 7/1987 Stein
4,907,488 A 3/1990 Seberger
4,974,489 A 12/1990 Fishbaugh
5,029,512 A 7/1991 Latka
5,611,409 A 3/1997 Arseneau
6,079,311 A 6/2000 O'Quinn et al.
6,374,718 B1 4/2002 Rescigno et al.
6,575,074 B1 6/2003 Gaddini
6,595,099 B1 7/2003 Olson et al.
6,796,214 B2 9/2004 Hausken et al.
6,796,403 B1 9/2004 Laughlin
6,848,538 B2 2/2005 Shafer
7,073,426 B1 7/2006 White
7,237,467 B1 7/2007 Melton
7,308,967 B1 12/2007 Hoel
7,412,917 B2 8/2008 Vais
7,516,690 B2 4/2009 McClellan
7,600,606 B2 10/2009 Brittingham
7,610,992 B2 11/2009 Brittingham
7,789,008 B2 9/2010 Petersen
7,832,323 B1 11/2010 Davies
7,856,914 B2 12/2010 Shults et al.
7,905,171 B1 3/2011 Brittingham
7,931,118 B1 4/2011 Cronhelm
7,987,944 B1 8/2011 Brittingham et al.
8,096,222 B2 1/2012 Silvers
8,100,224 B1 1/2012 Olson
8,104,570 B2 1/2012 Miller et al.
D657,012 S 4/2012 Woodell
8,162,100 B2 4/2012 Shults et al.
8,167,084 B1 5/2012 Moore
8,171,840 B2 5/2012 Kline et al.
8,292,025 B1 10/2012 Woodell et al.
8,307,946 B1 11/2012 Johnston
8,424,441 B2 4/2013 Brittingham et al.
8,424,635 B1 4/2013 Klawnn
8,439,155 B2 5/2013 Shults
8,453,789 B1 6/2013 Honigmann et al.
D685,874 S 7/2013 Andrews, Jr. et al.
8,474,361 B2 7/2013 Brittingham
8,479,632 B2 7/2013 Kline et al.
8,490,535 B1 7/2013 Moore et al.
8,505,431 B2 8/2013 Hines
8,511,425 B2 8/2013 Larue
8,516,941 B1 * 8/2013 Oliver ..... F41A 21/30 181/223
8,528,691 B1 9/2013 Carmichael et al.
8,567,556 B2 10/2013 Dueck et al.
8,579,075 B2 11/2013 Brittingham et al.
8,584,794 B2 11/2013 Dueck
8,714,301 B2 5/2014 Shults
8,739,922 B2 6/2014 Wirth et al.
8,770,084 B2 7/2014 Young
8,807,272 B2 8/2014 Bladen
8,820,473 B1 9/2014 White
8,833,512 B2 9/2014 Smith et al.
8,910,745 B2 12/2014 Latka
8,910,746 B1 12/2014 McKenzie
8,950,310 B2 2/2015 Storrs et al.
8,950,546 B2 2/2015 Shults
8,967,325 B1 * 3/2015 Cronhelm ..... F41A 13/00 181/223
8,973,481 B2 3/2015 Dueck et al.
8,978,818 B2 3/2015 Proske
8,991,550 B2 3/2015 Coley
8,991,552 B2 * 3/2015 Latka ..... F41A 21/30 181/223
9,038,770 B1 5/2015 Morrison
9,038,771 B1 5/2015 Mueller
9,046,316 B1 6/2015 Young
9,086,248 B2 7/2015 Young et al.
9,091,502 B1 7/2015 Morrison
9,097,482 B1 8/2015 Holden et al.
9,102,010 B2 8/2015 Wilson
9,103,618 B2 8/2015 Daniel et al.
9,115,949 B1 8/2015 Morrison
9,115,950 B2 8/2015 Bethlenfalvy
9,121,656 B1 9/2015 McKenzie
9,175,920 B2 * 11/2015 Moore ..... F41A 21/44
9,194,640 B2 11/2015 Wirth et al.
9,207,033 B2 12/2015 Vais
9,261,317 B2 2/2016 Daniel et al.
9,322,607 B1 4/2016 Lau
9,328,984 B2 5/2016 Shults et al.
9,347,727 B1 5/2016 Cler
2004/0173403 A1 9/2004 Shafer
2006/0123983 A1 6/2006 Vais
2007/0107590 A1 5/2007 Silvers
2009/0139795 A1 6/2009 Brittingham
2010/0180759 A1 7/2010 Petersen
2010/0218671 A1 9/2010 Mayberry et al.
2011/0056111 A1 3/2011 Brittingham
2011/0067950 A1 3/2011 Shults et al.
2011/0132683 A1 6/2011 Miller et al.
2011/0174141 A1 7/2011 Adolphsen
2011/0220434 A1 9/2011 Silvers
2011/0297477 A1 12/2011 Koumbis
2012/0048644 A1 3/2012 Kline et al.
2012/0080261 A1 4/2012 Shand
2012/0145478 A1 6/2012 Brittingham
2012/0152093 A1 6/2012 Koumbis
2012/0152649 A1 6/2012 Larue
2012/0167749 A1 7/2012 Young
2012/0180624 A1 7/2012 Troy et al.
2012/0199415 A1 8/2012 Shults et al.
2012/0255807 A1 10/2012 Pieratti
2013/0168181 A1 7/2013 Wirth et al.
2013/0175113 A1 7/2013 Hines
2013/0180796 A1 7/2013 Dueck et al.
2013/0199071 A1 8/2013 Lee
2013/0312592 A1 11/2013 Storrs et al.
2013/0319790 A1 12/2013 Bladen
2014/0020976 A1 1/2014 Shults
2014/0076658 A1 3/2014 Smith, II et al.
2014/0157640 A1 6/2014 Whelan
2014/0158459 A1 6/2014 Shults et al.
2014/0190345 A1 7/2014 Daniel et al.
2014/0224575 A1 8/2014 Latka
2014/0231168 A1 8/2014 Dueck et al.
2014/0237881 A1 * 8/2014 Mack ..... F41A 21/325 42/90
2014/0262602 A1 * 9/2014 Moss ..... F41A 21/30 181/211
2014/0262604 A1 9/2014 Proske
2014/0299405 A1 10/2014 Miller et al.
2014/0318887 A1 10/2014 Latka
2014/0374189 A1 12/2014 Young et al.
2015/0090105 A1 4/2015 Pace
2015/0226506 A1 8/2015 Shults et al.
2015/0260472 A1 9/2015 Smith
2015/0260473 A1 9/2015 Barney
2015/0267986 A1 9/2015 Sellars
2015/0276340 A1 10/2015 Vais
2015/0285575 A1 10/2015 Sclafani
2015/0292829 A1 10/2015 Pietila
2015/0323276 A1 11/2015 Myers et al.
2015/0338183 A1 11/2015 Salvador
2016/0018179 A1 * 1/2016 Morris ..... F41A 21/30 181/223
2016/0061551 A1 3/2016 Petersen
2016/0076844 A1 3/2016 Miller, III

(56) References Cited

U.S. PATENT DOCUMENTS

| | | | |
|---|---|---|---|
| 2016/0084602 | A1 | 3/2016 | Smith |
| 2016/0109205 | A1 | 4/2016 | Coppinger et al. |

FOREIGN PATENT DOCUMENTS

| | | | | | |
|---|---|---|---|---|---|
| DE | 2540419 | A1 | * | 3/1977 | ..... F41A 21/30 |
| EP | 166802 | A1 | | 1/1986 | |
| EP | 2977708 | A1 | | 1/2016 | |
| GB | 356224 | A | * | 8/1931 | ..... F41A 21/30 |
| GB | 426575 | A | | 4/1935 | |
| GB | 579168 | A | | 7/1946 | |
| GB | 614464 | A | | 12/1948 | |
| GB | 966934 | A | | 8/1964 | |
| GB | 2104197 | A | | 3/1983 | |
| GB | 2281119 | A | | 2/1995 | |
| GB | 2529462 | A | | 2/2016 | |
| WO | WO 2008-147446 | A2 | | 12/2008 | |
| WO | WO 2009-139803 | A2 | | 11/2009 | |
| WO | WO 2012-045119 | A1 | | 4/2012 | |
| WO | WO 2013-109655 | A1 | | 7/2013 | |
| WO | WO 2014-076356 | A1 | | 5/2014 | |
| WO | WO 2014-076357 | A1 | | 5/2014 | |
| WO | WO 2015-048127 | A1 | | 4/2015 | |

* cited by examiner

MODULAR SILENCER SYSTEM

CROSS REFERENCE TO RELATED APPLICATIONS

The present Patent Application is a formalization of previously filed, U.S. Provisional Patent Application Ser. No. 62/104,209, filed on Jan. 16, 2015 by the inventor named in the present Application. This Patent Application claims the benefit of the filing date of this cited Provisional Patent Application according to the statutes and rules governing provisional patent applications, particularly 35 U.S.C. §119(e), and 37 C.F.R. §§1.78(a)(3) and 1.78(a)(4). The specification and drawings of the Provisional Patent Application referenced above are specifically incorporated herein by reference as if set forth in their entirety.

TECHNICAL FIELD

The present disclosure relates to silencers, specifically to improved designs of the end cap, baffle core, and body, including improved designs that facilitate assembly and disassembly of the end cap, baffle core, and body.

BACKGROUND

Silencers for firearms, including rifles and handguns, are well known and have been used for reducing recoil effects, muzzle flash, and the sound signature of a host firearm, and thus offer many advantages to the user. For example, muzzle flashes can be harmful to the user's night vision and can also provide a visual cue as to the location of the person discharging a firearm. Likewise, the sound or report upon firing a firearm will also provide an audible cue to the location of a shooter and can further cause significant harm to the shooter's hearing. Silencers have been developed to mitigate or substantially eliminate these concerns. However, combustion gases, carbon and other materials created during firing of projectiles through a silencer tend to create a residue that can build up inside the silencer and make the parts difficult to separate and/or disassemble as needed for cleaning.

SUMMARY

The present disclosure is directed to a silencer or noise suppressor generally comprising multiple sections or pieces. In one embodiment, the silencer will comprise a three part or piece design, including a forward portion/section, which may include a central body or tube section, a rearward portion/section such as an end cap, and a baffle core. The end cap can be secured to the exterior surface of a body forward portion/section, overlapping an end thereof, instead of being received and threaded into the interior of the forward portion/section. The baffle core generally may include a body having a series of baffles with a central passage defined therethrough, a first, proximal end and a second distal end. The baffle core may be received within an interior chamber of the body of the forward portion such that at least a portion of the core protrudes beyond the length of the forward portion/section from the interior chamber, extending rearwardly from the open, first or proximal end of the forward portion/section, so as to be engaged by the end cap as the end cap is applied thereover. The projecting portion of the baffle core also may define a junction or break area between the core and tube to facilitate separation of the core from the tube, such as for disassembly of the silencer and removal of the baffle core to facilitate cleaning or maintenance.

The baffle core further can include a flange or other suitable projection portions at its proximal end, configured to limit and substantially arrest forward movement of the core into the forward section/section, and which also generally will include a series of interruptions, notches or gaps formed therein, and which can interface with one or more spaced tabs or other suitable portions located along the open rear or proximal end of the forward section/portion. The engagement of the tabs of the forward portion with the interruptions of the baffle core can assist in adjusting a rotational orientation of the core within the body of the forward portion and help minimize point of impact shifting of the core during firing.

Various features, advantages, and embodiments of the disclosure may be set forth or apparent from consideration of the following Detailed Description, the appended drawings, and the claims. Moreover, it is to be understood that both the foregoing summary of the disclosure and the following detailed description are exemplary and intended to provide further explanation without limiting the scope of the disclosure as claimed.

DESCRIPTION OF THE DRAWINGS

The accompanying drawings, which are included to provide a further understanding of the invention, are incorporated in and constitute a part of this specification, illustrate embodiments of the invention, and together with the detailed description, serve to explain the principles of the invention. No attempt is made to show structural details of the invention in more detail than may be necessary for a fundamental understanding of the invention and the various ways in which it may be practiced. In addition, it will be understood by those skilled in the art that the embodiments of the invention and the various features thereof discussed below are explained in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques further may be omitted so as to not unnecessarily obscure the embodiments of the invention.

DETAILED DESCRIPTION

Figure 1:
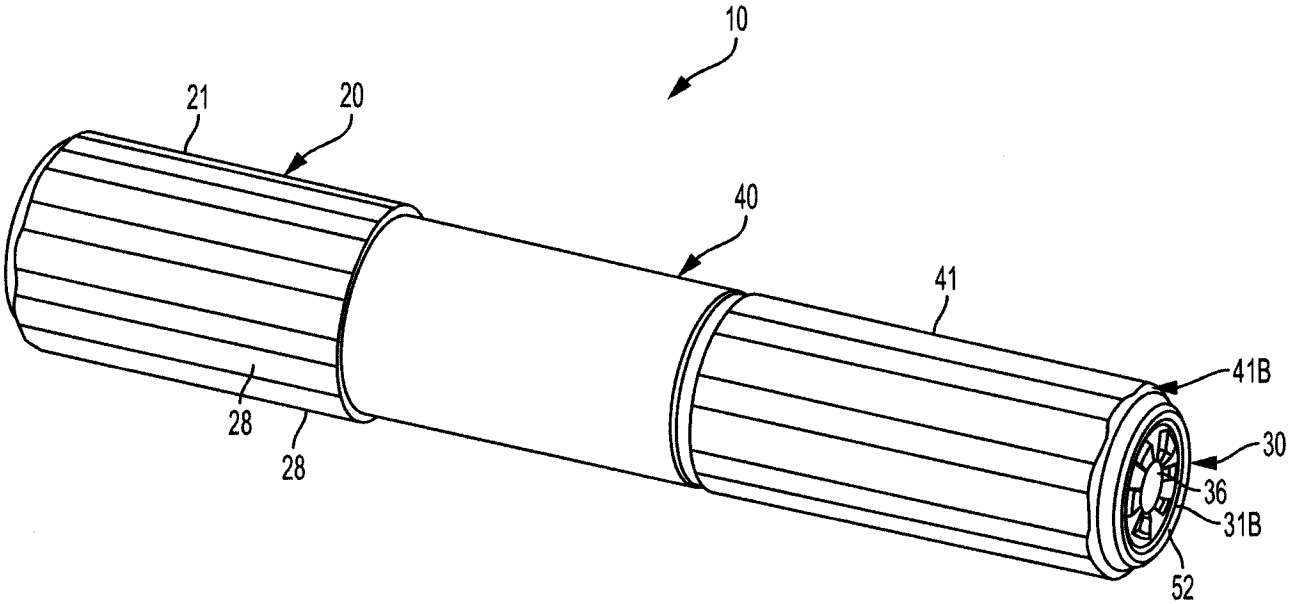
FIG. 1 shows a perspective view of a silencer according to an example embodiment of the present disclosure.

Turning now to the drawings in which like reference characters indicate corresponding elements throughout the several views, attention is directed to FIGS. 1 through 4 which illustrate several innovative aspects of a silencer according to embodiments of the present disclosure. In the exemplary embodiments shown, the silencer can be used with various other types of firearms, including, but not limited to, rifles and other types of long guns, as well as various types of pistols or handguns. In one embodiment of the disclosure described herein, the silencer 10 comprises three components, including a first, rearward portion or section, such as an end cap 20, a baffle core 30, and a second, forward portion or section 40 including a body 41 generally formed as a tube or sleeve.

As used herein, the terms "front," "forward," "upstream" or "distal" will generally correspond to the direction which a discharged projectile would pass through the silencer 10 (i.e., to the right as shown in the figures), while "back," "rear," "rearward," "downstream" or "proximal" will typically correspond to the direction opposite the direction of such a discharged projectile passing through the silencer 10 (i.e., to the left as shown in the figures); "longitudinal" generally refers to a direction extending along or parallel to the longitudinal axis of the silencer 10; while "transverse" generally refers to a direction perpendicular to the longitudinal direction.

As schematically shown in FIGS. 1-2A, 3A and 4B, the silencer 10 generally can comprise three sections, including a first, rearward portion or section, such as an end cap 20, a baffle core 30, and a second, forward portion or section 40, which may include a tube or tubular portion generally having an elongated body 41. These components may be configured to be easily assembled and/or disassembled, such as for cleaning and/or routine maintenance. Although the figures show these individual sections or pieces as substantially cylindrical in shape, these sections or pieces further could be formed with alternative body shapes or configurations, such as substantially eccentric or rectangular, oval, or otherwise configured without departing from the invention detailed herein. Generally, the silencer 10 will be assembled by inserting the baffle core 30 through an open, proximal end 41A of the body/tube 41 of the forward portion 40 with the baffle core 30 being at least partially received into, or housed/disposed in, and extending along an interior chamber 45 of tube or body 41. The end cap 20 can then be arranged and mated or otherwise secured onto the tube or body 41 in a position at least partially overlapping, or extending over, an exterior surface 40A of the tube or body 41 at, adjacent, or near proximal end 41A and at least a portion of the baffle core 30 at, adjacent or near proximal end 31A, which portion extending or projecting from the interior chamber by a selected or predetermined length.

Figures 2A, 2B, 2C:
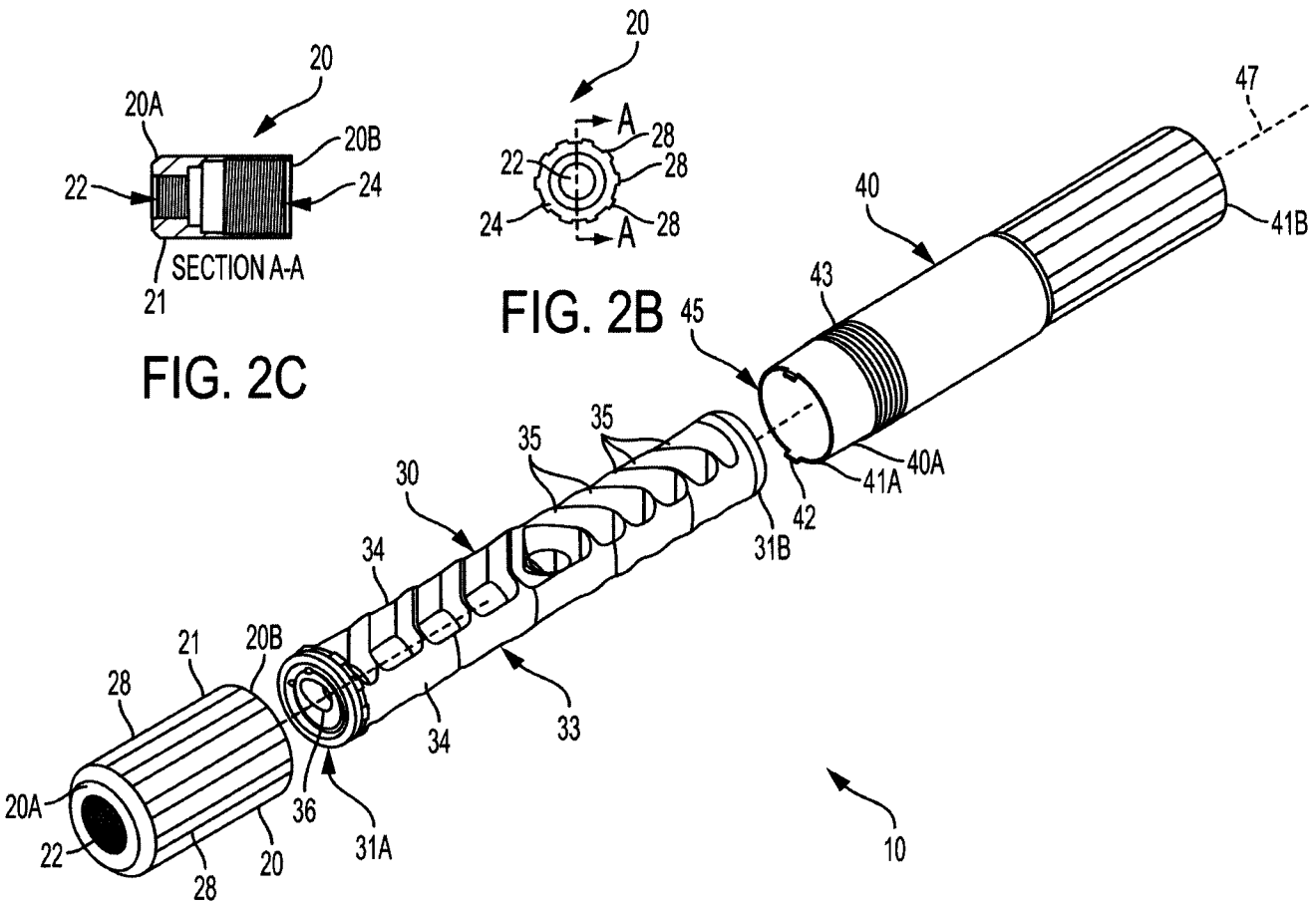
FIGS. 2A-2C show views of the rear end cap of the silencer of FIG. 1.
Figure 3A:
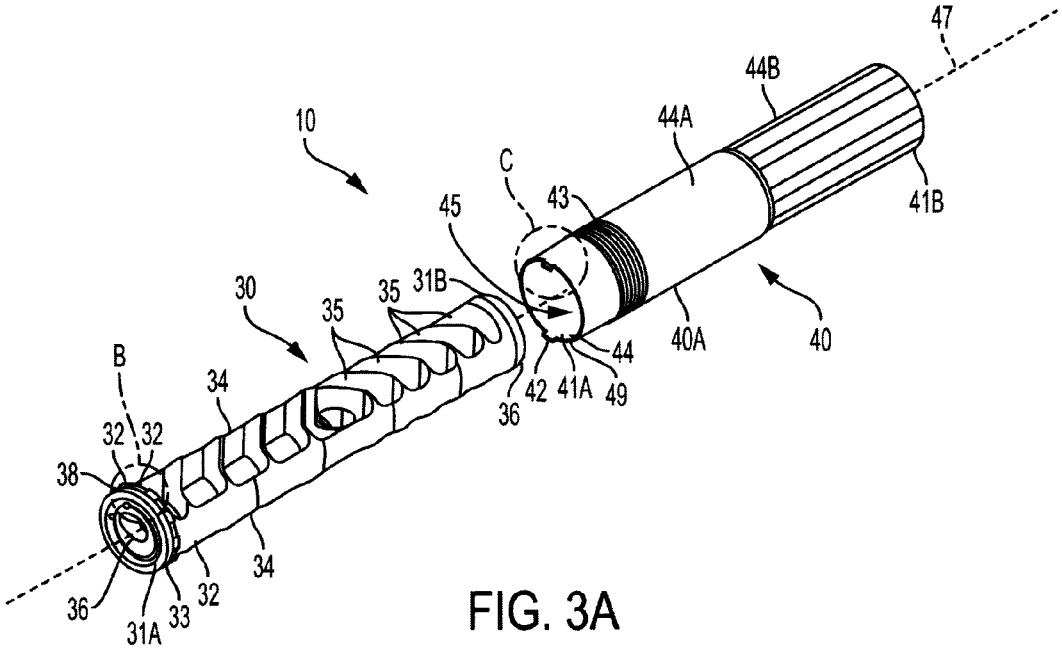
FIGS. 3A-3D show views of the one-piece core and flange of the silencer of FIG. 1.

As shown in further detail in FIGS. 2A and 3A, in one embodiment, the baffle core 30 can include a body 33 with a series of spaced peripheral portions 34. The body 33 of the baffle core can be comprised of a substantially unitary structure, or can include multiple inter-connecting pieces or sections. The body 33 may further have a series of asymmetrical baffles 35 each with an aligned bore or opening 36 defining a passage extending along the longitudinal axis 47 (FIG. 3A) and through which a projectile can pass through the silencer 10. The baffle core 30 may be removed for replacement and/or for cleaning of residue, debris and/or other materials from the fired projectiles and the combustion gases passing therethrough.

As shown in FIGS. 2B and 2C, the end cap 20 may further include an interface with a corresponding interface defined along the exterior surface 40A of the body/tube 41 so as to reinforce and provide increased strength about the body/tube 41. For example, the end cap 20 generally will include a body 21 having firearm interface threads 22 at a first, proximal end 20A, configured to mate with, or otherwise be coupled or secured to, a barrel of a firearm (not shown), and tube interface threads 24 at its opposite, distal end 20B to enable the end cap 20 to be secured to the tube or body 41 of the forward section/portion 40. An opening or aperture 23 may be defined through the body 21, which aperture or opening 23 may be substantially aligned with the passage defined by the opening(s) 36 of the baffle core 30 so as to allow a fired or discharged projectile to pass through the silencer 10. Unlike many silencers that feature a rear end cap that is threaded into the tube, or welded into the tube, the tube interface threads 24 of end cap 20 thread onto, or otherwise engage with, the outside or exterior surface 40A of the body/tube of the forward portion 40. By providing tube interface threads 24 that thread onto corresponding threads 43 arranged along an outside or exterior surface 40A of the tube/body 41, the end cap 20 can provide substantial/nontrivial reinforcement to the body of the forward portion 40, for example, by providing additional hoop strength at the upstream end thereof where gas pressures generally are greater, which is an important consideration with pressure vessels like silencers.

In addition to threading onto the outside of the tube/body 41, according to one example embodiment of the present disclosure, the end cap 20 can have a preselected extended length so as to overlap at least a portion of the tube/body 41, such as a portion of the outside or exterior surface 40A substantially adjacent to the proximal end 41A of the tube/body 41, by a prescribed, predetermined, selected or desired length, which can help provide the desired/selected additional hoop strength along the body/tube 41 and also increase gas sealing effects, or gas sealing capacity, for example, to create a seal between the end cap 20 and the tube/body 41 of the forward portion 40. End cap 20 can also include a textured exterior surface 28 that facilitates secure gripping of the end cap 20, such as during installation and/or removal of the silencer 10 from the firearm. The textured exterior surface is shown as ridges 28 in FIG. 2B, though other texture effects or other suitable notches or grooves also could be employed with embodiments of this disclosure. The extended length and textured exterior surface of the end cap 20 thus can help facilitate assembly/disassembly of the end cap 20 with/from the tube 40, by enabling users to securely grip the end cap 20 during installation and removal of the silencer 10, for unscrewing the end cap 20 from the tube/body 41 during assembly/disassembly.

Figure 3B:
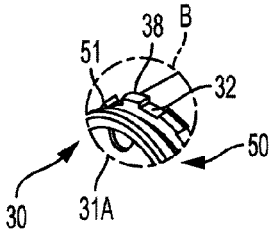

FIGS. 3A-3D illustrate the relationship between the tube/body 41 and the baffle core 30. The baffle core 30 may feature a flange 38 adjacent its proximal end 31A, the surface of which flange 38 may be interrupted by a plurality of spaced notches, grooves, gaps or other interruptions 32. Where conventional silencers often utilize a separate front end cap to capture the baffle or baffle core in the tube/body, after the baffle core 30 according to embodiments of this disclosure is inserted into the tube 41 from the rear, the flange 38 can engage or press against a surface of the tube/body 41, such as rear end or face 49, so as to arrest forward longitudinal movement of the core 30 into the passage 45 of the tube/body 41. Rearward longitudinal movement of the core 30 also can be substantially fixed or arrested when the end cap 20 is installed over the proximal end 41A of the tube/body 41. As additionally shown in FIGS. 2A, 3A and 4B, the body or tube 40 of the silencer 10 can include fore 44A and aft 44B sections/portions with an open, first or proximal end 40A and external threads 43 defined at the fore section 44A and a second or distal end 41B, at the opposite end of the aft section 44B. Aft section 44B can include textured surface features such as ridges or knurling, to help in gripping the silencer body, and these surface features can be disposed on or defined in the exterior surface 40A of the tube/body 41. The tube or body 41 of the silencer 10 further will define an elongated interior chamber 45 extending along a longitudinal axis 47 of the silencer (FIG. 3B). The distal end 41B of the body/tube 41 can further include, or otherwise be configured to receive, a forward cap or rim 46 (FIG. 4B), which can include a seal 48 configured to press and/or seal against the second, distal or fore end 31B of the baffle core 30, as indicated in FIG. 4B. The cap or rim 46 of the distal end may further have an aperture or opening 47 defined therein, which may be substantially aligned with the opening/aperture 28 of the end cap 20 and the passage of the baffle core 30, so as to allow a projectile fired/expelled from the firearm to pass through the silencer 10.

Figure 3C:
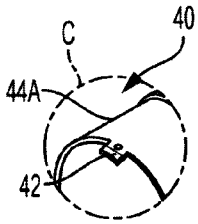
Figure 3D:
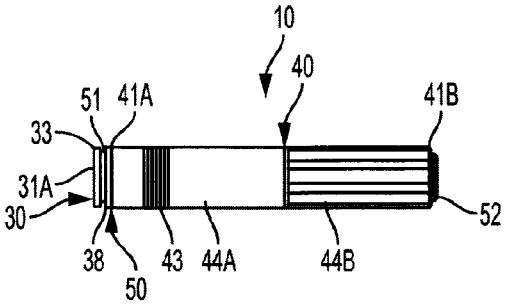
Figure 4B:
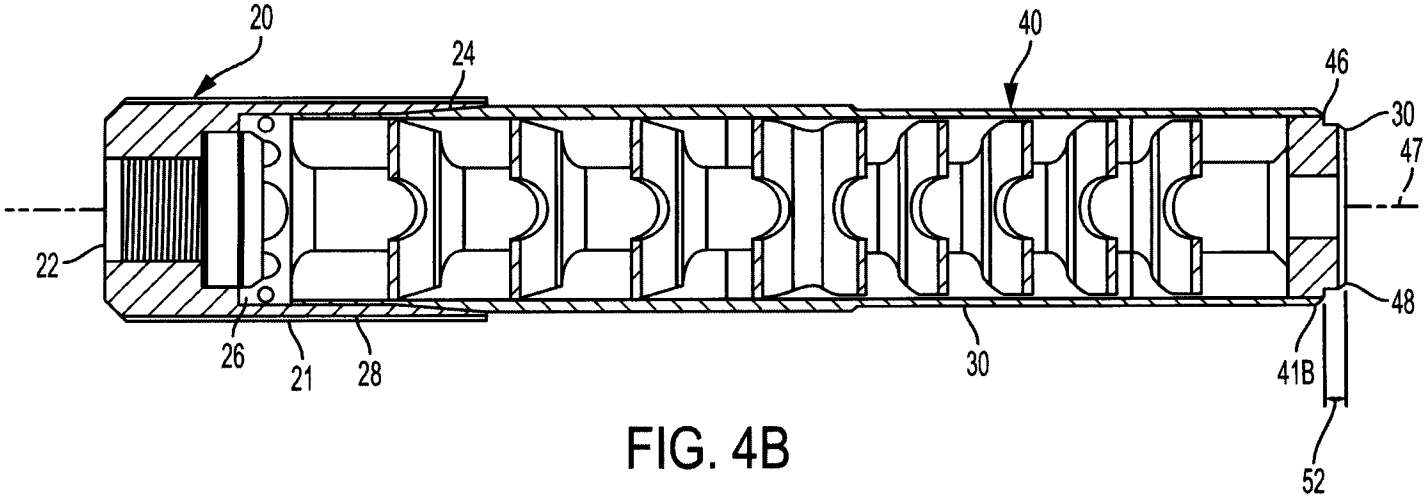
FIG. 4B is a cross-sectional view of the silencer taken along line D-D of FIG. 4A.
Figure 4A:
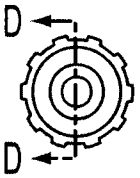
FIG. 4A is an end elevation view of the silencer according to FIG. 1.

Additionally, as schematically indicated in FIGS. 3A-3C, the proximal end 41A of the tube 40, or a portion of the exterior surface 40A substantially adjacent to the proximal end 41A of the tube/body 41, may include a number of protruding tabs or other protrusions 42 (shown in detail C of FIG. 3C), and when the core 30 is inserted into the body/tube 41, these tabs 42 interface with notches 32 defined or disposed on the baffle core 30 to rotationally lock the core 30 and tube/body 41 together, creating a junction 50 (FIG. 3D) between the baffle core 30 and tube/body 41. This interaction between tabs 42 and notches 32 can rotationally lock the core 30 and tube/body 41 together and can enable or otherwise facilitate adjustment of the rotational orientation of the core 40, which can minimize point-of-impact shift during and/or after firing of the firearm. These notches 32 are shown in FIG. 3B.

Unlike most silencers that use a separate front end cap to capture the baffles or baffle core in the tube, when the baffle core 30 is inserted into the tube/body 41 from the rear, flange 38 rests against the rear face 49 of the tube 41 and arrests forward movement of the core 30. Rearward movement of the core 30 thus is also substantially arrested when the end cap 30 is installed. Also, as indicated in FIG. 4B, when installed, the end cap 20 can push against a rear face 35, or other surface, of the baffle core 30, capturing or securing the core flange 38 between the end cap 20 and the rear face 49 of the tube/body 41, such as in a sandwich-type arrangement, so as to help maintain or otherwise facilitate a substantially sealed fit engagement or configuration between silencer components, for example creating a gas seal between the end cap 20 and tube/body 41. In addition, when assembled with the tube/body 41, a portion of the core 30 adjacent its proximal end 31 and flange 38 may protrude from or extend past the first or proximal end 41A of the tube/body 41 so as to define junction 50 therebetween. This junction 50 can provide a spacing or gap 51 of a sufficient size to enable receipt of a tool between the flange 38 and a rim 33 defined about the proximal end 31A of the core as needed to aid in removing the core 30 when disassembling the silencer 10, such as for cleaning and/or maintenance purposes.

To disassemble the silencer 10, from the position shown in FIG. 4B, the rear cap 20 can be unscrewed and removed from the tube/body 41, after which a front protruding section 52 of core 30 (projecting from the distal end 41B of the tube) can be pressed down, such as by a user's fingers or against a surface or other stable object while the tube/body 41 is held, generally firmly. The force of pressing the protruding section 52 generally will dislodge the core 30 from the tube/body 41, and can be aided by use of stepped tube profile technology, such as that disclosed in U.S. Pat. No. 7,600,606 B2. This force also generally will disengage the tabs 42 on the tube/body 41 from the notches 32 in the core flange 38 of the core 30. Also, if needed a tool can be engaged at the junction 50 therebetween to help disengage the core. This disengagement is especially helpful when the inside of the silencer 10 is dirty from use.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A silencer for a firearm, the silencer comprising:

a rearward portion having a proximal end and a distal end, the rearward portion configured to couple to a barrel of the firearm and including an aperture configured to receive a projectile fired from the firearm therethrough;

a forward portion including an elongated body with an open, proximal end and a distal end, and an interior chamber defined therein, the body configured to arrange and mate with the distal end of the rearward portion with a length of the rearward portion overlapping an exterior surface of the body of the forward portion; and a baffle core removably received within the interior chamber of the body of the forward portion, the baffle core comprising a core body including a series of spaced peripheral portions and a projectile passage extending through the peripheral portions and substantially aligned with the aperture of the rearward portion so as to allow the projectile fired from the firearm to pass therethrough;

wherein at least a portion of the baffle core protrudes from an exterior surface of the baffle core and extends beyond the interior chamber of the forward portion, and is engaged by the rearward portion when the forward and rearward portions are mated so as to substantially seal the baffle core therebetween, while further facilitating disassembly of the silencer and removal of the baffle core.

2. The silencer according to claim 1, wherein the portion of the baffle core that extends beyond the interior chamber of the elongated body defines a break area between the forward portion and the baffle core to facilitate separation of the forward portion and the baffle core.

3. The silencer according to claim 1, wherein the rearward portion comprises an end cap.

4. The silencer according to claim 3, wherein the end cap includes an interface portion configured to releasably engage and mate with a corresponding interface along the exterior surface of the body of the forward portion so as to reinforce and provide increased strength about the body of the forward portion.

5. The silencer according to claim 1, further comprising a series of threads disposed along a surface of the rearward portion adjacent its distal end and configured to cooperatively engage one or more threads disposed along the exterior surface of the body of the forward portion.

6. A silencer for a firearm, comprising:

a rearward portion having a proximal end and a distal end, the rearward portion configured to couple to a barrel of the firearm and including an aperture configured to receive projectiles fired from the firearm therethrough;

a forward portion including an elongated body with an open, proximal end and a distal end, and an interior chamber defined therein, the body configured to arrange and mate with the distal end of the rearward portion with a length of the rearward portion overlapping an exterior surface of the body of the forward portion; and a baffle core removably received within the interior chamber of the body of the forward portion, the baffle core comprising:

a core body including a series of spaced peripheral portions and a projectile passage extending through the peripheral portions and substantially aligned with the aperture of the rearward portion so as to allow projectiles fired from the firearm to pass therethrough; and a flange that protrudes from the interior chamber of the forward portion, wherein the flange is configured to engage against the open end of the body of the forward portion sufficient to substantially arrest movement of the baffle core, and is secured between the forward portion and the rearward portion when the forward and rearward portions are mated so as to provide a gas seal between the forward and rearward portions.

7. The silencer according to claim 6, wherein the rearward portion is dimensioned so as to receive and engage a rear face of the baffle core so as to capture the flange of the baffle core between the rearward portion and the open end of the elongated body.

8. The silencer according to claim 1, wherein the forward portion further comprises one or more tabs disposed substantially adjacent a proximal end of its elongated body, the tabs configured to interface with one or more notches defined along the baffle core sufficient to at least partially arrest rotational movement between the elongated body and the baffle core.

9. The silencer according to claim 1, wherein the baffle core comprises a substantially unitary structure or multiple interconnecting sections.

10. The silencer according to claim 1, wherein the rearward portion comprises a textured exterior surface to facilitate gripping thereof during installation and/or removal of the silencer from the firearm.

11. The silencer according to claim 1, wherein the baffle core comprises a series of asymmetrical baffles each including an opening forming the projectile passage extending through the baffle core.

12. The silencer according to claim 1, further comprising a forward cap including one or more seals, the forward cap configured to be received at the distal end of the body of the forward portion so that the one or more seals press against a distal end of the baffle core.

13. A noise suppressor for a firearm, the noise suppressor comprising:

a substantially tubular portion defining an interior chamber within which a baffle core is releasably received, the tubular portion having a length such that a portion of the baffle core that is adjacent a proximal end of the baffle core extends at least partially out of the interior chamber, the baffle core comprising a series of baffles each having a bore defined therein to form a passage configured to allow projectiles fired by the firearm to pass therethrough; and an end cap comprising an end cap body having a proximal end configured to mount to a barrel of the firearm, and a distal end configured to couple to the tubular portion adjacent the rear end thereof;

wherein the portion of the baffle core that extends at least partially out of the interior chamber is captured between the end cap and the tubular portion, with a gas seal created between the end cap and the tubular portion, and wherein the tubular portion includes one or more protruding tabs configured to interface with one or more notches defined along the baffle core so as to at least partially inhibit rotational movement of the baffle core within the interior chamber.

14. The noise suppressor according to claim 13, wherein the end cap is secured to the tubular portion such that at least a portion of the end cap overlaps an exterior surface of the tubular portion.

15. A noise suppressor for a firearm, comprising:

a substantially tubular portion defining an interior chamber within which a baffle core is releasably received, the tubular portion having a length such that a portion of the baffle core extends at least partially out of the interior chamber, wherein the baffle core comprises a series of baffles each having a bore defined therein to form a passage configured to allow projectiles fired by the firearm to pass therethrough, and a flange extending about the portion of the baffle core extending out of the interior chamber and being configured to engage against a rear end face of the tubular portion to at least partially restrict longitudinal movement of the baffle core along the interior chamber of the tubular portion; and an end cap comprising an end cap body having a proximal end configured to mount to a barrel of the firearm, and a distal end configured to couple to the tubular portion adjacent the rear end thereof;

wherein the baffle core is captured between the end cap and the tubular portion, with a gas seal created between the end cap and the tubular portion, wherein the tubular portion includes one or more protruding tabs configured to interface with one or more notches defined along the baffle core so as to at least partially inhibit rotational movement of the baffle core within the interior chamber.

16. The noise suppressor according to claim 13, wherein the baffle core comprises a series of asymmetrical baffles.

17. The noise suppressor according to claim 13 wherein the portion of the baffle core that extends at least partially out of the interior chamber defines a junction between the tubular portion and the baffle core that is of a length sufficient to facilitate separation between the tubular portion and the baffle core.

18. The noise suppressor according to claim 13, wherein the one or more notches are defined along the flange of the baffle core.

19. A method for assembling a silencer for a firearm, comprising:

inserting a baffle core into an interior chamber of a substantially tubular body, the baffle core extending along the interior chamber of the tubular body with at least a portion of the baffle core that protrudes from an exterior surface of the baffle core projecting rearwardly from the interior chamber of the tubular body by a selected length;

locating an end cap onto the tubular body with at least a portion of the end cap overlapping a portion of an exterior surface the tubular body and the portion of the baffle core being captured between the end cap and the tubular body; and releasably securing the end cap onto the exterior surface of the tubular body sufficient to form a gas seal and to provide additional strength and reinforcement to the tubular body at an upstream end thereof.

20. The method of claim 19, further comprising substantially arresting rotational movement of the baffle core via engagement of a series of grooves defined in the baffle core with a series of protrusions arranged along the tubular body.

* * * * *